US006560972B2

(12) United States Patent
Ubidia

(10) Patent No.: US 6,560,972 B2
(45) Date of Patent: May 13, 2003

(54) RETROFIT SYSTEM AND METHOD FOR A CARBONATED BEVERAGE DISPENSER

(75) Inventor: Fernando A. Ubidia, Ludlow, MA (US)

(73) Assignee: SerVend International, Inc., Sellersburg, IN (US)

( * ) Notice: Subject to any disclaimer, the term of this patent is extended or adjusted under 35 U.S.C. 154(b) by 0 days.

(21) Appl. No.: 09/925,280

(22) Filed: Aug. 8, 2001

(65) Prior Publication Data

US 2002/0033027 A1 Mar. 21, 2002

Related U.S. Application Data

(60) Provisional application No. 60/223,783, filed on Aug. 8, 2000.

(51) Int. Cl.[7] ..... F25D 3/00

(52) U.S. Cl. ..... 62/59; 62/77; 62/298; 222/146.6

(58) Field of Search ..... 62/389, 400, 77, 62/98, 59, 298; 222/146.6

(56) References Cited

U.S. PATENT DOCUMENTS

| | | | | | |
|---|---|---|---|---|---|
| 3,056,273 | A | | 10/1962 | Cornelius | 62/393 |
| 3,926,342 | A | | 12/1975 | Selvia et al. | 222/129.1 |
| 4,520,950 | A | * | 6/1985 | Jeans | 137/212 |
| 4,730,463 | A | * | 3/1988 | Stanfill | 222/146.6 |
| 4,754,609 | A | * | 7/1988 | Black | 62/389 |
| 4,781,309 | A | * | 11/1988 | Vogel | 137/561 A |
| 4,781,310 | A | | 11/1988 | Credle, Jr. et al. | 222/129.1 |
| 4,907,417 | A | * | 3/1990 | Forsythe | 62/199 |
| 4,909,047 | A | * | 3/1990 | Koeneman et al. | 222/146.6 |
| 5,190,189 | A | | 3/1993 | Zimmer et al. | 222/67 |
| 5,249,710 | A | * | 10/1993 | Hassell et al. | 222/129.1 |
| 5,280,711 | A | * | 1/1994 | Motta et al. | 62/177 |
| 5,319,947 | A | * | 6/1994 | Fischer | 62/389 |
| 5,350,086 | A | * | 9/1994 | Martin et al. | 222/129.1 |
| 5,397,032 | A | | 3/1995 | Landers | 222/146.6 |
| 5,524,452 | A | | 6/1996 | Hassell et al. | 62/389 |
| 5,549,219 | A | * | 8/1996 | Lancaster | 222/1 |
| 5,727,421 | A | | 3/1998 | Murphy | 73/304 R |
| 5,792,391 | A | | 8/1998 | Vogel et al. | 261/121.1 |
| 5,839,291 | A | | 11/1998 | Chang | 62/126 |
| 5,987,900 | A | * | 11/1999 | Love | 62/348 |
| 5,996,842 | A | * | 12/1999 | Riley et al. | 222/1 |

* cited by examiner

*Primary Examiner*—William E. Tapolcai
*Assistant Examiner*—Mohammad M. Ali
(74) *Attorney, Agent, or Firm*—McAndrews, Held & Malloy, Ltd.

(57) ABSTRACT

The present invention provides a system and method for enhancing the carbonation efficiency of an ice-chilled beverage dispenser. The system includes a beverage dispenser having an ice bin, a pre-chill coil proximate a portion of a store of ice in the ice bin; and an under-counter assembly having a carbonator in fluid flow communication with the pre-chill coil, and a pump for pumping water through said system. Water flows through the pre-chill coil prior to flowing through the carbonator. The present invention provides various methods of converting existing ice-chilled beverage dispensers including installing a pre-chill coil proximate to a store of ice in the ice bin so that water flows through the pre-chill coil before it flows through the carbonator. Another method includes diverting the flow of water from a water chill coil to the carbonator, instead of a plain water valve to which fluid originally flowed from the water chill coil. Also, the tubing that connects a water chill coil may be branched so that water flows from the water chill coil to the plain water valve and the carbonator.

22 Claims, 5 Drawing Sheets

RETROFIT SYSTEM AND METHOD FOR A CARBONATED BEVERAGE DISPENSER

CROSS-REFERENCE TO RELATED APPLICATIONS

This application relates to and claims priority benefits from U.S. Provisional Patent Application No. 60/223,783 filed Aug. 8, 2000 entitled "Retrofit Kit for a Carbonated Beverage Dispenser" which is incorporated by reference herein in its entirety.

BACKGROUND OF THE INVENTION

The present invention generally relates to dispensers for carbonated beverages and more particularly to a kit for retrofitting existing beverage dispensers in order to improve carbonation levels in the dispensed beverages.

Beverage dispensers are well known in the art. U.S. Pat. No. 5,397,032 to Landers and U.S. Pat. No. 4,781,310 to Credle et al. provide background information for such devices. In a typical beverage dispenser, carbonated water is mixed with syrup to produce beverages such as carbonated soft drinks. The carbonated water is provided from a carbonation tank (or carbonator) where non-carbonated water is mixed with carbon dioxide. Typical beverage dispensers, however, provide beverages with lower levels of carbonation as compared to bottled and canned beverages. Carbonation levels may be improved by enhancing the efficiency of the carbonator.

Beverage dispensers typically include coils of tubing arranged in a serpentine fashion for cooling or chilling the water and syrups. In one type of beverage dispenser, the chill coils typically are embedded in a cold plate that is cooled by a store of ice. This type of beverage dispenser may be described as an ice-cooled dispenser. In another type of beverage dispenser, the chill coils are immersed in a water bath that is cooled by mechanical refrigeration. This type of beverage dispenser may be described as a counter-electric dispenser.

For ice-cooled dispensers, the carbonators typically are installed in a location remote from the main body of the beverage dispenser. For example, the carbonator may be installed in a back room while the main body of the beverage dispenser is in the general location where the beverages are dispensed and the chill coils are located. The distance between the carbonator and the main body of the beverage dispenser typically ranges from about five (5) feet to over one hundred (100) feet. In these systems, the carbonators generally are relatively large. For example, the carbonators in these systems may hold about two gallons of carbonated water.

For ice-cooled dispensers of this type, an ambient water supply is used to provide non-carbonated water into the carbonator. In other words, the non-carbonated water is not cooled or chilled before it is introduced into the carbonator. After the non-carbonated water is mixed with carbon dioxide in the carbonator, the carbonated water flows through tubing to a chill coil embedded in a cold plate that is cooled with a store of ice, as described above. Such a chill coil may be described as a post-chill coil because it is used to chill the carbonated water after it exits the carbonator. After the carbonated water is chilled by passing through the post-chill coil, the carbonated water flows through tubing to a manifold where it is distributed to valves for dispensing the carbonated beverages. Syrups are mixed with the carbonated water in valve nozzles.

Ice-cooled dispensers of this type (that is, remote, ambient carbonation with no pre-chill coil) generally provide carbonation levels of about 18–24 psi (single sniff). Although these carbonation levels are acceptable by present industry standards, they fall short of bottle and can quality (that is, about 26–27 psi (single sniff)). Moreover, carbonation levels can vary with ambient temperatures. For example, carbonation levels may increase during cooler winter months (when the ambient water temperature is lower) as compared to warmer summer months.

Ice-cooled dispensers have been developed that use a built-in carbonator (as opposed to a remote carbonator) in conjunction with a pre-chill coil for the non-carbonated water before it enters the carbonator and a post-chill coil for the carbonated water after it exists the carbonator. The pre-chill coil and the post-chill coil are both embedded in the cold plate. In order to improve carbonation levels, these dispensers may also use a high efficiency carbonator and thermal insulation for components such as the carbonator and the tubing that are exposed to ambient temperature conditions. Ice-cooled dispensers of this type may provide carbonation levels that are comparable to bottle and can quality, that is, about 26–27 psi (single sniff). Such dispensers may be characterized by high efficiency, built-in carbonators; thermal insulation to minimize heat transfer where components such as the carbonator and tubing are exposed to ambient temperature conditions; and the combination of a pre-chill coil and a post-chill coil that are both embedded in a cold plate cooled by a store of ice.

SUMMARY OF THE INVENTION

The present invention relates generally to a means of retrofitting an existing beverage dispenser of the ice-cooled type to improve carbonation levels in the dispensed beverages. Certain embodiments of the present invention provide a retrofitted ice-cooled beverage dispensing system including a beverage dispenser having an ice bin, a pre-chill coil proximate a store of ice within the ice bin; and an assembly having a carbonator in fluid flow communication with the pre-chill coil and a pump for pumping water through the system. Water flows through the pre-chill coil prior to entering the carbonator. The system also includes a gasket located along an upper edge of the ice bin. The gasket protects inlet and outlet lines of the pre-chill coil.

An embodiment of the present invention provides a system wherein water is diverted from a first plain water chill coil to a carbonator while water supplied to a second plain water chill coil flows to a first dispensing valve and a second dispensing valve through branched tubing. The first dispensing valve was originally associated with the first plain water chill coil. Another embodiment provides a system wherein branched tubing positioned downstream of the first plain water chill coil provides a fluid path to both the first dispensing valve and the carbonator.

Another embodiment of the present invention provides a method of enhancing the carbonation efficiency of an ice-cooled beverage dispenser. The method includes the steps of installing a pre-chill coil proximate to a store of ice within an ice bin; and connecting the pre-chill coil to a carbonator, wherein the pre-chill coil is connected to the carbonator through insulated tubing; and moving water through the dispensing system with a pump, such that water flows through the pre-chill coil before it flows through the carbonator.

Another embodiment of the present invention provides a method of enhancing the carbonation efficiency of an ice-cooled beverage dispensing device including the step of converting a plain water chill coil of the beverage dispensing device into a pre-chill coil for water entering a carbonator of the beverage dispensing device. The method also for water entering a carbonator of the beverage dispensing device. The method also includes the step of connecting a water outlet of the plain water chill coil to a water inlet of a carbonator. Further, the method includes the steps of branching tubing that extends from a water outlet of a second plain water chill; connecting one branch of the outlet tubing to a water inlet of a first plain water valve; and connecting another branch of the outlet tubing to a water inlet of a second plain water valve. Also, the method includes the step of passing water from the plain water chill coil through tubing in a cold plate.

Another embodiment of the present invention provides a method for enhancing the carbonation efficiency of an ice-cooled beverage dispensing device including the steps of branching tubing that extends from a water outlet of a plain water chill coil, connecting one branch of the outlet tubing to a water inlet of a carbonator, such that water flows from the plain water chill coil to the carbonator; and connecting another branch of the outlet tubing to a water inlet of a plain water valve, such that water flows from the plain water chill coil to the plain water valve. The method also includes the step of passing water from the plain water chill coil through tubing in a cold plate.

BRIEF DESCRIPTION OF THE DRAWINGS

The foregoing summary, as well as the following detailed description of certain embodiments of the present invention, will be better understood when read in conjunction with the appended drawings. For the purpose of illustrating the invention, the drawings depict certain embodiments which are presently preferred. It should be understood, however, that the present invention is not limited to the precise arrangements and instrumentality shown in the attached drawings.

DETAILED DESCRIPTION OF THE DRAWINGS

Figure 1:
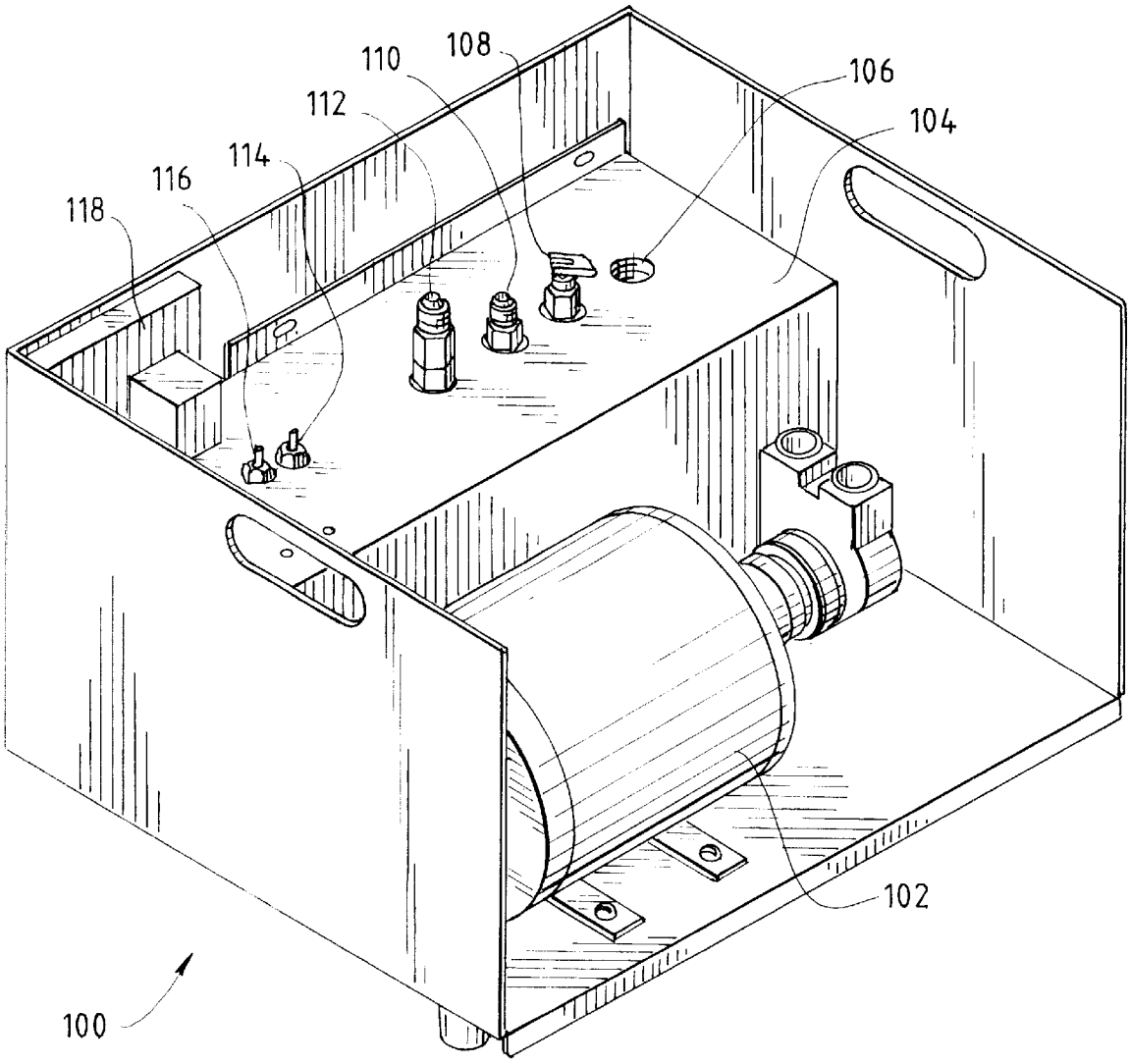
FIG. 1 illustrates an under counter assembly for a retrofit system formed in accordance with an embodiment of the present invention.

FIG. 1 illustrates an under counter assembly 100 for a retrofit system formed in accordance with an embodiment of the present invention. The assembly 100 includes a motor/pump 102, a carbonator housing 104, a carbonated water outlet 106, a pressure relief valve 108, a carbon dioxide inlet 110, a plain water inlet 112, a low probe 114, a high probe 116, and a liquid level control board 118. The assembly 100 may be installed under the beverage dispenser (not shown). Alternatively, the assembly 100 may be installed above or on the side of the beverage dispenser. The assembly 100 may be used with a variety of ice-cooled dispensers, including dispensers of either the upright type or the drop-in type. The assembly 100 can accommodate low volume carbonators (for example, 12 inches long) and high volume carbonators (for example, 17 inches long). In this embodiment, the carbonator within the carbonator housing 104 is arranged in a generally horizontal configuration so as to make better use of under-counter space. Also, due to the height-length aspect ratio, a relatively horizontal carbonator (as opposed to a vertical carbonator) provides for increased turbulence within the carbonator resulting in improved carbonation. However, the carbonator may be arranged vertically. The operation of the components of the assembly 100 are further described below with respect to FIGS. 3–5.

Figure 2:
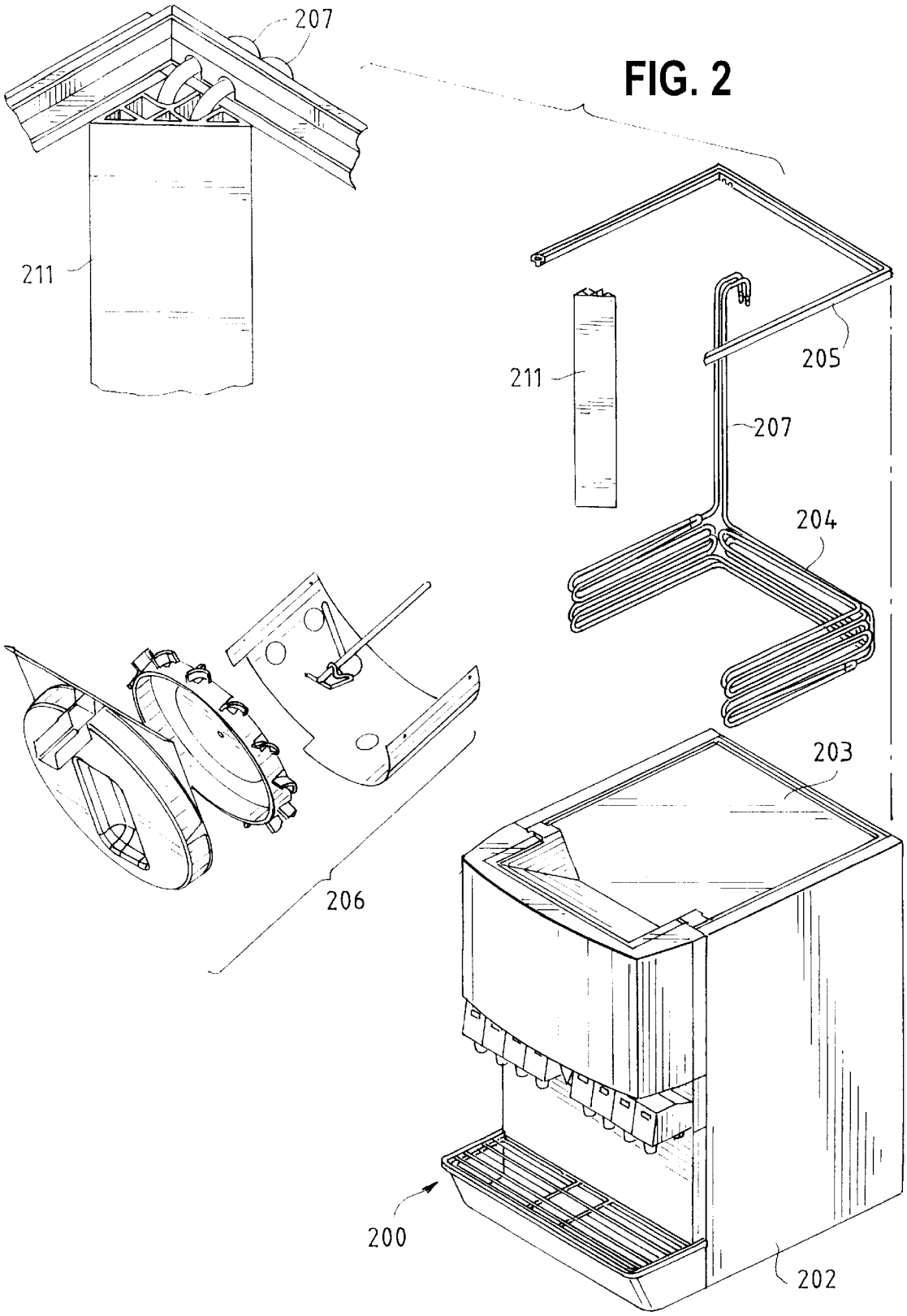
FIG. 2 is an exploded view of a beverage dispenser formed in accordance with an embodiment of the present invention.

FIG. 2 is an exploded view of a beverage dispenser 200 formed in accordance with an embodiment of the present invention. The beverage dispenser 200 includes a housing 202 that contains an ice bin 203, a pre-chill coil 204 having inlet and outlet tubing 207 and additional components 206. The pre-chill coil 204 is configured to be installed into an existing ice-cooled dispenser. As such, the retrofit system provides a compact, economical means of providing a pre-chill coil for an existing ice-cooled dispenser lacking such a pre-chill coil 204. The retrofit system includes the under-counter assembly 100 and the pre-chill coil 204.

Generally, the beverage dispenser 200 is not originally equipped with a pre-chill coil 204. Rather, the beverage dispenser 200 is modified so that the pre-chill coil 204 is installed within the dispenser 200. To install the pre-chill coil 204, the lid and original gasket are removed from the dispenser 200. As known to one skilled in the art, certain components 206 of the dispenser 200 need to be removed in order to fit the pre-chill coil 204 into the dispenser 200. After the pre-chill coil 204 is installed, the components 206 are re-installed. The pre-chill coil 204, however, is not embedded in a cold plate of the dispenser 200.

A gasket 205 is provided along the upper edge of the ice bin 203 that protects the inlet and outlet tubing 207 of the pre-chill coil 204. The gasket 205 may be designed either to interface with, or replace an existing gasket on the upper edge of the ice bin 203. The gasket 205 is extruded and adheres along the inside corner of the ice bin 203 to protect and position the inlet and outlet tubing 207. A tubing protector 211 may also be used exterior to the ice bin 203 to protect and position the tubing 207 extending between the carbonator and the pre-chill coil 204.

The pre-chill coil 204 is provided to cool the plain water (that is, the non-carbonated water) before it enters the carbonator. The pre-chill coil 204 is not embedded in a cold plate (not shown) of the beverage dispenser 200 with the other chill coils such as the post-chill coil and syrup coils. Rather, the pre-chill coil 204 extends around a portion of the inner periphery of the ice bin 203, generally towards the bottom of the ice bin 203, so that the pre-chill coil 204 generally contacts the store of ice (not shown).

Figure 3:
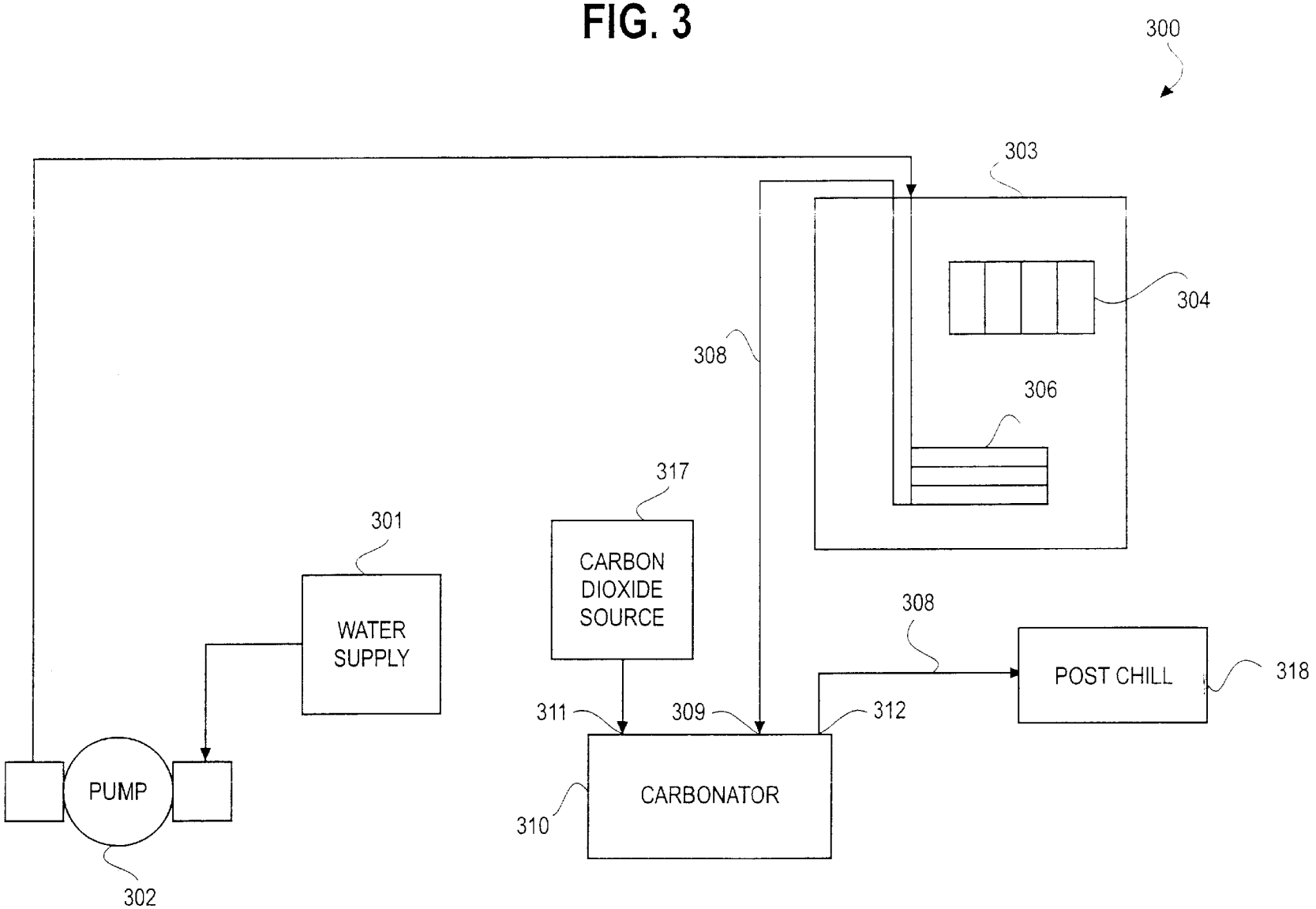
FIG. 3 is a schematic block diagram of a beverage dispenser retrofit system according to an embodiment of the present invention.

FIG. 3 is a schematic block diagram of a beverage dispenser retrofit system 300 according to an embodiment of the present invention. The system 300 includes a water supply 301, a motor/pump 302, a beverage dispenser 303, insulated tubing 308, a plain water inlet 309, a carbon dioxide inlet 311, a carbonated water outlet 312, a carbon dioxide source 317 and a carbonator 310. The beverage dispenser 303 includes valves 304 and a pre-chill coil 306. The motor/pump 302 and the carbonator 310 are preferably mounted within an assembly as shown in FIG. 1. The motor/pump 302 is connected to the dispenser 303 through tubing. The tubing allows water to flow from the motor/pump 302 to a water inlet on the dispenser 303. The water inlet of the dispenser 303 is in fluid flow communication with the inlet tubing of the pre-chill coil 304. The outlet tubing of the pre-chill coil 304 is in fluid flow communication with the insulated tubing 308. The insulated tubing 308 is connected to the carbonator 310 through the plain water inlet 309. Additional tubing connects a carbon dioxide source (not shown) to the carbon dioxide inlet 311 of the carbonator 310. Additional tubing connects the carbonated water inlet 312 of the carbonator 310 to an existing post-chill coil 318, valves and other components (not shown) of the system 300.

In operation, plain water is provided from an ambient water supply 301, typically within the range of about 50 to 80 degrees Fahrenheit. The water enters the motor/pump 302. The motor/pump 302 pumps the water through tubing to the water inlet of the dispenser 303. Water then flows from the water inlet of the dispenser 303 to the inlet tubing of the pre-chill coil 306. The pre-chill coil 306 is cooled by a store of ice within the ice bin (not shown in FIG. 3) of the dispenser 303. The water is chilled to a temperature of 35–45 degrees Fahrenheit as it travels through the pre-chill coil 306. The chilled water exits the pre-chill coil 306, and consequently the dispenser 303, through the outlet tubing of the pre-chill coil 306. The water then travels through the insulated tubing 308 and enters the carbonator 310 through the plain water inlet 309. The water is carbonated within the carbonator 310 by carbon dioxide supplied to the carbonator 310 from a carbon dioxide source 317. The carbonated water then travels through the carbonated water outlet 312 into tubing. The carbonated water then travels to an existing post-chill coil 318. From the post-chill coil 318, the carbonated water flows to an existing manifold where it is distributed to the existing beverage dispensing valves 304. In the nozzle of each valve, the carbonated water is mixed with syrup to provide the desired beverage.

The carbonator 310 is well insulated to minimize temperature gains as the pre-chilled water is carbonated. Similarly, the tubing between the pre-chill coil 306 and the carbonator 310, the carbonator 310 and the post-chill coil 318 (embedded in the cold plate), and the post chill coil 318 and manifold and valves 304, is well insulated. By maintaining cooler water temperatures, the insulation improves carbonation of plain water in the carbonator 310 and the retention of carbonation in the carbonated water as it flows from the carbonator to the beverage dispensing valves 304.

Figure 4:
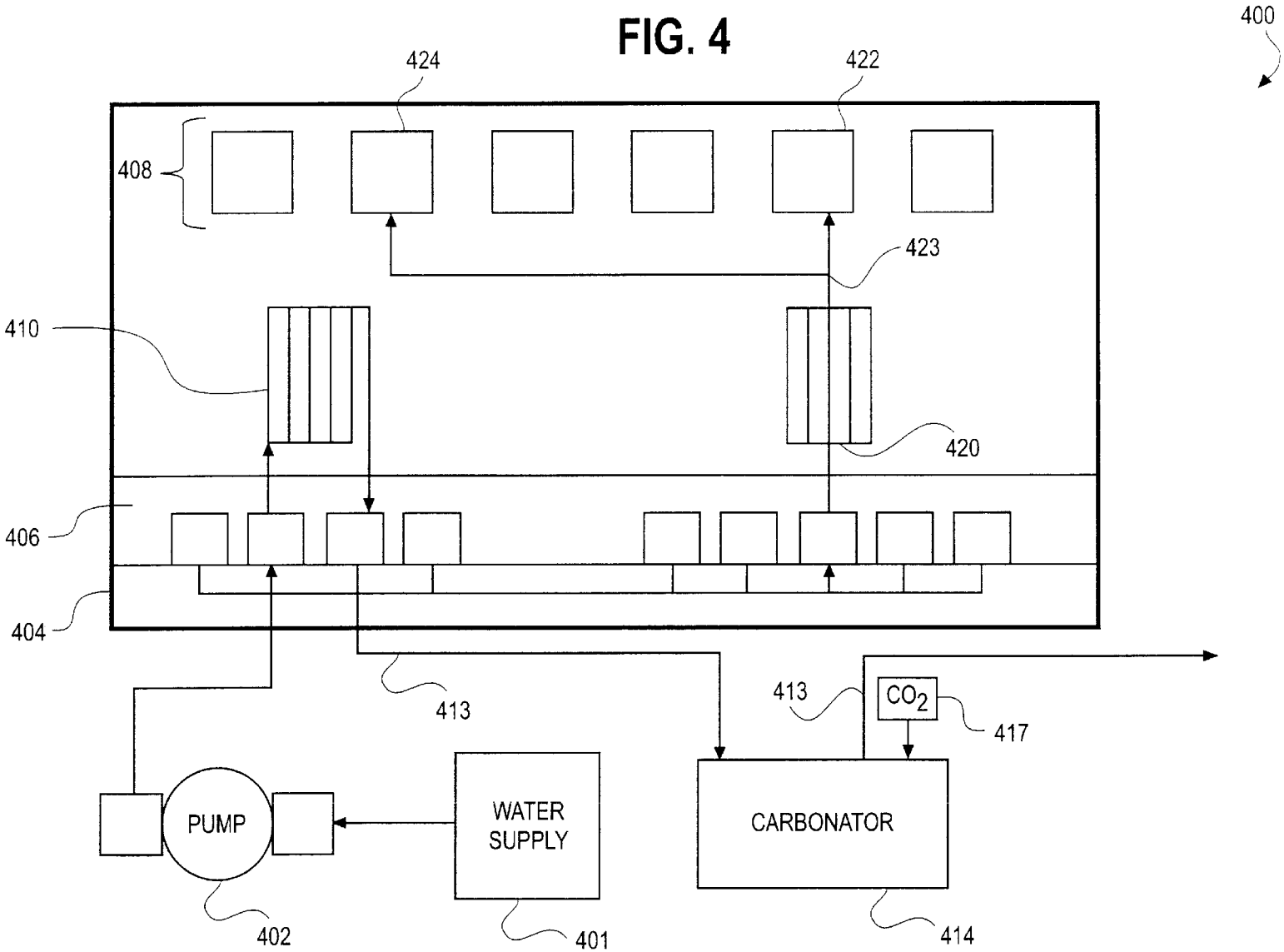
FIG. 4 is a schematic block diagram of a converted plain water coil beverage dispenser retrofit system according to an embodiment of the present invention.

FIG. 4 is a schematic block diagram of a beverage dispenser retrofit system 400 according to an embodiment of the present invention where an existing plain water coil has been converted into a pre-chill coil. The system 400 includes a water supply 401, a motor/pump 402, a beverage dispenser 404, insulated tubing 413, a carbonator 414, and a carbon dioxide source 417. The beverage dispenser 404 includes a cold plate 406, a converted plain water chill coil 410, dispensing valves 408, and branched tubing 423. The dispensing valves 408 include a first dispensing valve 424 and a second dispensing valve 422.

The system 400 uses an existing plain water chill coil 410 to provide the pre-chill coil for the water entering the carbonator 414. That is, the existing plain water chill coil 410 is converted into a pre-chill coil. As is well known in the art, beverage dispensers typically provide non-carbonated beverages in addition to carbonated beverages. Accordingly, for existing ice-cooled beverage dispensers, the chill coils embedded in the cold plate 406 include plain water chill coils for the non-carbonated beverages in addition to a post-chill coil for the carbonated water and chill coils for the syrups. In the system 400, the existing beverage dispenser may be modified by converting a first plain water chill coil 410 into a pre-chill coil for water entering the carbonator 414. The modification may be accomplished by altering the plumbing of the dispenser 404 so that the plain water exiting the converted first plain water chill coil 410 flows to the carbonator rather than the first dispenser valve 424 otherwise associated with the converted chill coil 410. The plumbing is further modified such that water exiting a second plain water chill coil 420 into branched tubing 423 flows to both the second dispensing valve 422 associated with the second plain water chill coil 420 and the first dispensing valve 424 that was originally associated with the first plain water chill coil 410. Thus, plain water flows from the second plain water chill coil 420 to both dispensing valves 422 and 424 while water chilled by the converted plain water chill coil 410 flows to the carbonator 414.

Figure 5:
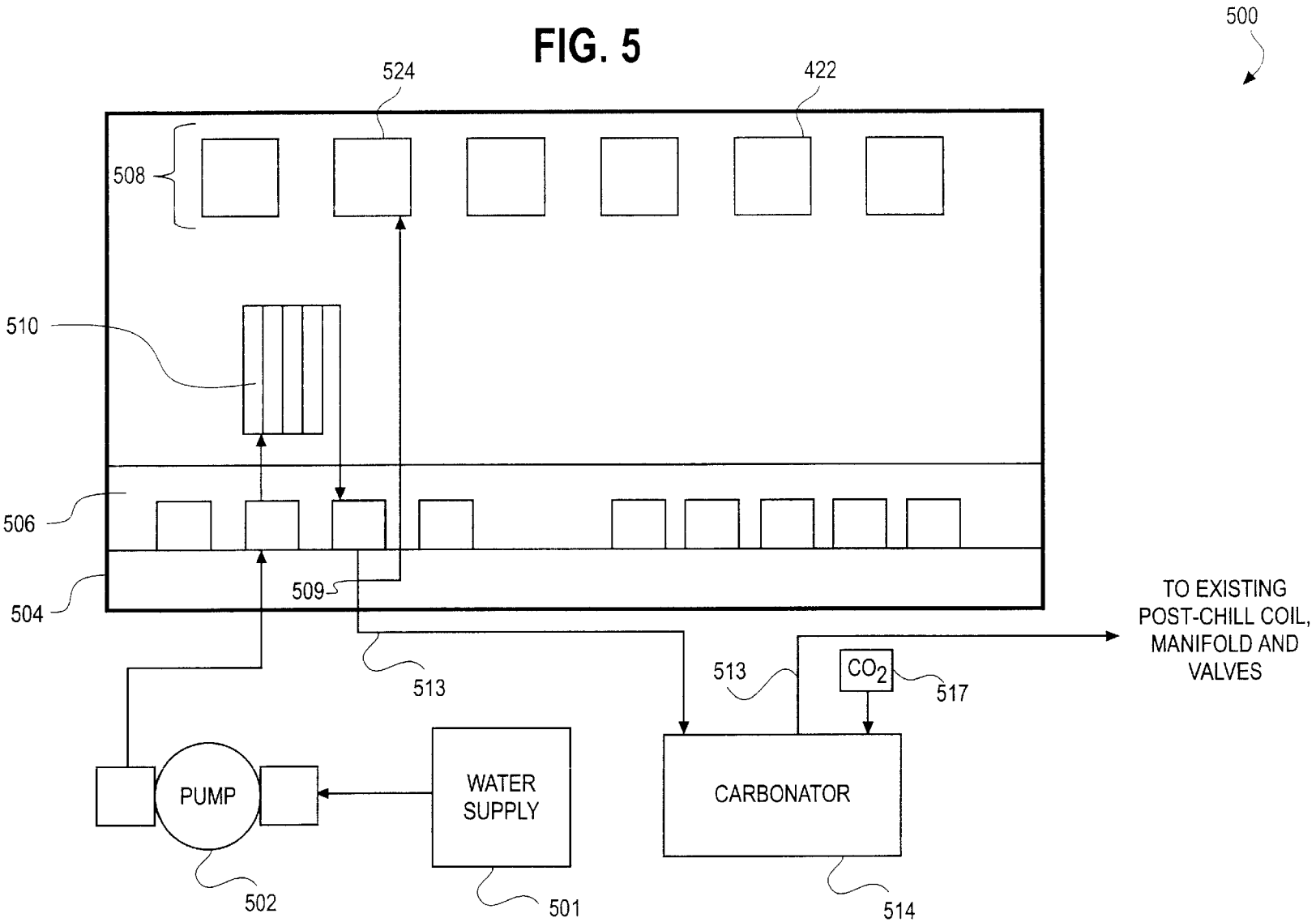
FIG. 5 is a schematic block diagram of an alternative converted plain water coil beverage dispenser retrofit system according to an embodiment of the present invention.

FIG. 5 is a block diagram of a beverage dispenser retrofit system 500 according to another embodiment of the present invention where an existing plain water coil has been converted into a pre-chill coil. The system 500 includes a water supply 501, a motor/pump 502, a beverage dispenser 504, insulated tubing 513, a carbonator 514, and a carbon dioxide source 517. The beverage dispenser 504 includes a cold plate 506, a plain water chill coil 510, dispensing valves 508 including a first dispensing valve 524, and branched tubing 509.

In the system 500, an existing plain water chill coil 510 is used as a pre-chill coil for the water entering the carbonator 514. More specifically, an existing plain water chill coil 510 is converted so that it serves both as a plain water chill coil and a pre-chill coil. This is accomplished by altering the plumbing of the dispenser 504 so that the plain water flowing from the existing plain water chill coil 510 flows to both the carbonator 514 and the existing plain water valve 524 for dispensing non-carbonated beverages. Specifically, branched tubing 509 allows chilled water to flow to the first valve 524 and the carbonator 514.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications that incorporate those features coming within the scope of the invention.

What is claimed is:

1. A method of retrofitting an ice-cooled beverage dispenser comprising:

a) providing an existing ice-cooled beverage dispenser having an ice bin without a pre-chill coil;

b) installing a pre-chill coil within the ice bin;

c) providing a conduit for water from the pre-chill coil to a carbonator;

d) connecting a water outlet of the pre-chill coil to the conduit;

e) connecting a water inlet of the carbonator to the conduit; and f) connecting a supply of water to the beverage dispenser such that water flows through the pre-chill coil before entering the carbonator.

2. The method of claim 1 further comprising positioning a gasket located along an edge of the ice bin to protect inlet and outlet lines of the pre-chill coil.

3. The method of claim 1 where the pre-chill coil is not embedded a cold plate.

4. The method of claim 3 where at least a portion of the is exposed to direct contact with ice within the ice bin.

5. The method of claim 1 further comprising:

a) providing carbon dioxide to the carbonator;

b) carbonating the water with the carbonator; and c) passing carbonated water through a post-chill coil positioned downstream of the carbonator.

6. The method of claim 5 further comprising passing the carbonated water through a distributing manifold positioned downstream of the post-chill coil.

7. The method of claim 6 further comprising distributing the carbonated water to beverage dispensing valves.

8. A method for retrofitting an ice-cooled beverage dispenser comprising:

a) providing an existing ice-cooled beverage dispenser having a carbonator and having a plain water chill coil in fluid communication with a first plain water valve;

b) converting the plain water chill coil into a pre-chill coil for water entering the carbonator;

c) providing a conduit for water from the converted chill coil to the carbonator;

d) connecting a water outlet of the converted chill coil to the conduit; and e) connecting a water inlet of the carbonator to the conduit.

9. The method of claim 8 wherein the converted chill coil is embedded in a cold plate.

10. The method of claim 8 further comprising:

branching tubing that extends from a water outlet of a second plain water chill coil;

connecting one branch of the outlet tubing to a water inlet of the first plain water valve; and connecting another branch of the outlet tubing to a water inlet of a second plain water valve.

11. The method of claim 8 further comprising providing carbon dioxide to the carbonator.

12. The method of claim 8 further comprising carbonating the water with the carbonator.

13. The method of claim 12 further comprising passing carbonated water a post-chill coil positioned downstream of the carbonator.

14. The method of claim 13 further comprising passing the carbonated water through a distributing manifold positioned downstream of the post-chill coil.

15. The method of claim 14 comprising distributing the carbonated water to beverage dispensing valves.

16. The method of claim 8 further comprising passing water from the converted plain water chill coil through tubing in a cold plate located upstream from the carbonator.

17. A method for retrofitting an ice-cooled beverage dispenser comprising:

a) providing an existing ice-cooled beverage dispenser having a carbonator and having an ice bin without a pre-chill coil;

b) providing a pre-chill coil to cool water before it enters the carbonator;

c) providing a conduit for water from the pre-chill coil to the carbonator;

d) connecting a water outlet of the pre-chill coil to the conduit;

e) connecting a water inlet of the carbonator to the conduit; and f) connecting a supply of water to the beverage dispenser such that water flows through the pre-chill coil before entering the carbonator.

18. The method of claim 17 wherein the step of providing a pre-chill coil comprises installing a pre-chill coil within the ice bin of the existing beverage dispenser.

19. The method of claim 17 wherein the step of providing a pre-chill coil comprises converting a plain water chill coil of the existing beverage dispenser into a for water entering the carbonator.

20. The method of claim 18 wherein the pre-chill coil is not embedded in a cold plate and is exposed at least in part to ice within the ice bin.

21. The method of claim 19 further comprising:

branching tubing that extends from a water outlet of a second plain water chill coil;

connecting one branch of the outlet tubing to a water inlet of a first plain water valve; and connecting another branch of the outlet tubing to a water inlet of a second plain water valve.

22. The method of claim 17 further comprising:

branching tubing that extends from a water outlet of a plain water chill coil;

connecting one branch of the tubing to a water inlet of a carbonator, such that water flows from the plain water chill coil to the carbonator; and connecting another branch of the tubing to a water inlet of a plain water valve, such that water flows from the plain water chill coil to the plain water valve.

* * * * *